US008661779B2

(12) United States Patent
Laster et al.

(10) Patent No.: US 8,661,779 B2
(45) Date of Patent: Mar. 4, 2014

(54) FLEX-FUEL INJECTOR FOR GAS TURBINES

(75) Inventors: Walter R. Laster, Oviedo, FL (US); Weidong Cai, Oviedo, FL (US); Timothy A. Fox, Hamilton, CA (US); Kyle L. Landry, Winter Park, FL (US)

(73) Assignee: Siemens Energy, Inc., Orlando, FL (US)

( * ) Notice: Subject to any disclaimer, the term of this patent is extended or adjusted under 35 U.S.C. 154(b) by 862 days.

(21) Appl. No.: 12/356,131

(22) Filed: Jan. 20, 2009

(65) Prior Publication Data

US 2010/0077760 A1 Apr. 1, 2010

Related U.S. Application Data

(60) Provisional application No. 61/100,448, filed on Sep. 26, 2008.

(51) Int. Cl.
*F02C 3/20* (2006.01)

(52) U.S. Cl.
USPC ..... 60/39.463; 60/737; 60/742; 60/748

(58) Field of Classification Search
USPC ..... 60/742, 746–748, 39.463; 239/400
See application file for complete search history.

(56) References Cited

U.S. PATENT DOCUMENTS 4,342,198 A * 8/1982 Willis ..... 60/742
4,761,948 A * 8/1988 Sood et al. ..... 60/39.281
5,351,477 A 10/1994 Joshi et al.
5,511,375 A 4/1996 Joshi et al.
5,657,632 A * 8/1997 Foss ..... 60/742
6,082,111 A 7/2000 Stokes
6,438,961 B2 * 8/2002 Tuthill et al. ..... 60/742
6,675,581 B1 1/2004 Stuttaford et al.
6,722,132 B2 4/2004 Stuttaford et al.
6,848,260 B2 2/2005 North et al.
6,935,117 B2 * 8/2005 Cowan ..... 60/742
7,171,813 B2 2/2007 Tanaka et al.
7,316,117 B2 1/2008 Ohri
7,370,466 B2 5/2008 Cai
7,908,864 B2 * 3/2011 Haynes et al. ..... 60/748
8,113,002 B2 * 2/2012 Lacy et al. ..... 60/748
2004/0006991 A1 1/2004 Stuttaford et al.

(Continued)

FOREIGN PATENT DOCUMENTS

CN 101158479 A 4/2008

OTHER PUBLICATIONS

Dorf, R.C., Editor-in-Chief, The Engineering Handbook, CRC Press, Inc., Boca Raton, Florida, 1996, pp. 991-996.*

*Primary Examiner* — William H Rodriguez
*Assistant Examiner* — Lorne Meade

(57) ABSTRACT

A fuel injector (36) for alternate fuels (26A, 26B) with different energy densities. Vanes (47B) extend radially from a fuel delivery tube structure (20B) with first and second fuel supply channels (19A, 19B). Each vane has first and second radial passages (21A, 21B) communicating with the respective fuel supply channels, and first and second sets of apertures (23A, 23B). The first fuel supply channel, first radial passage, and first apertures form a first fuel delivery pathway providing a first fuel flow rate at a given fuel delivery pathway backpressure that is essentially common to both sets of fuel delivery pathway apertures. The second fuel supply channel, second radial passage, and second apertures form a second fuel delivery pathway providing a second fuel flow rate that may be at least 1 about twice the first fuel flow rate at the given fuel delivery pathway backpressure.

20 Claims, 7 Drawing Sheets

(56) References Cited

U.S. PATENT DOCUMENTS

2004/0060297 A1 4/2004 Koenig et al.
2007/0000228 A1 1/2007 Ohri et al.
2007/0080097 A1* 4/2007 Bridges et al. ..... 208/106
2007/0289311 A1 12/2007 Rising
2008/0078183 A1 4/2008 Ziminsky et al.
2008/0163627 A1* 7/2008 ELKady et al. ..... 60/737
2008/0183362 A1* 7/2008 Dooley et al. ..... 701/100

* cited by examiner

FIG 3 PRIOR ART FUEL INJECTOR
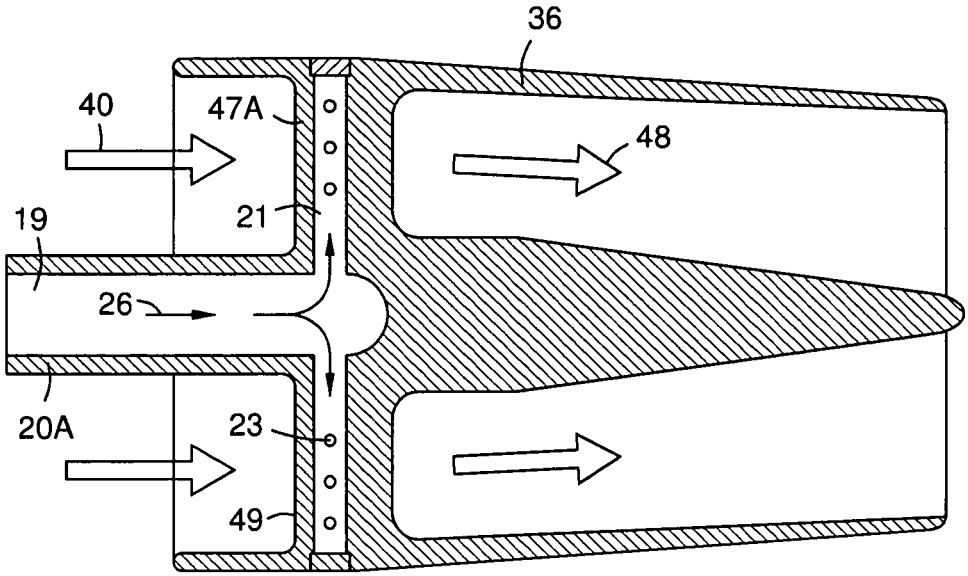
FIG 4 PRIOR ART INJECTOR VANE
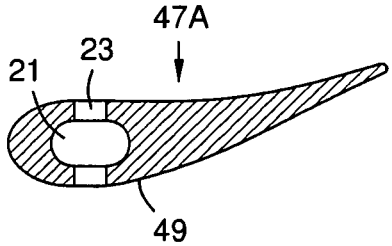

FIG 5 FLEX-FUEL INJECTOR
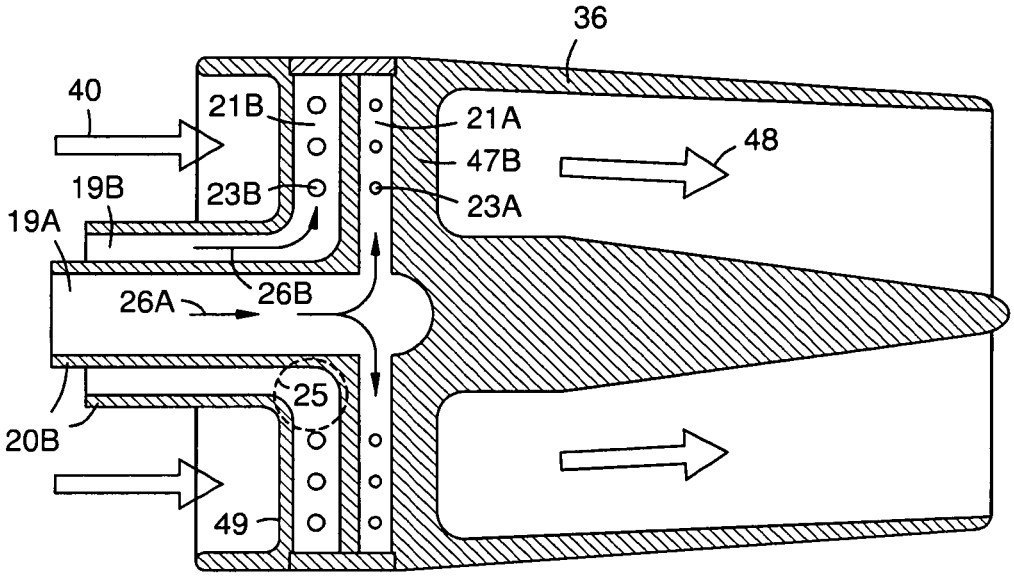
FIG 6 FLEX-FUEL INJECTOR VANE
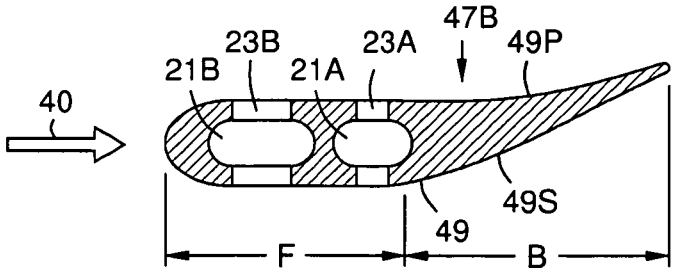

FIG 7 FLEX-FUEL INJECTOR
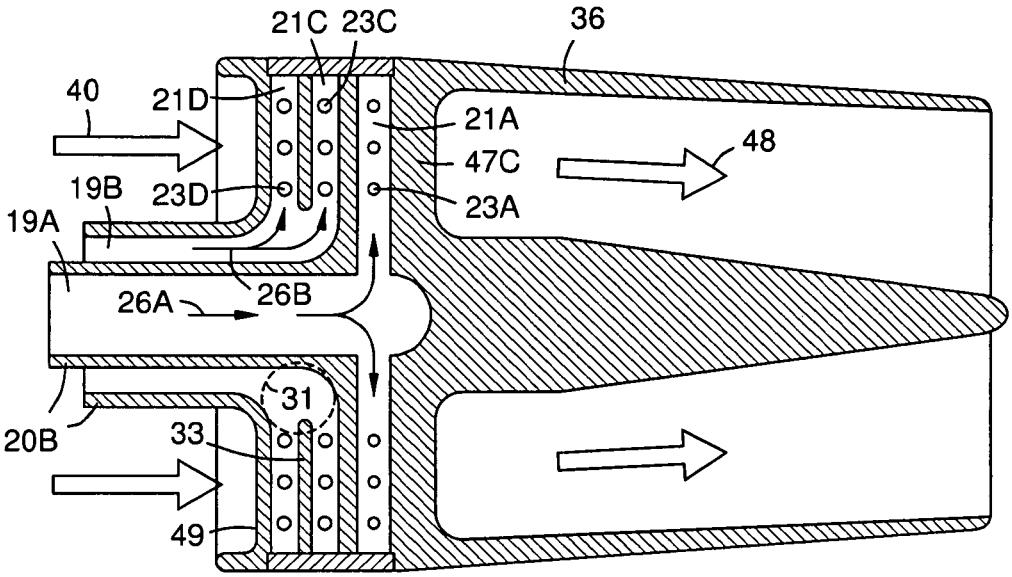
FIG 8 FLEX-FUEL INJECTOR VANE
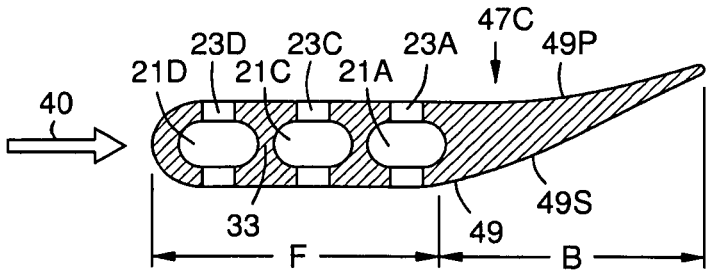

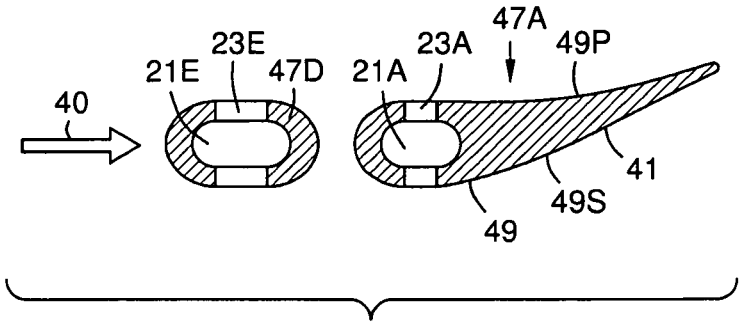
FIG 9 FLEX-FUEL INJECTOR VANES
FIG 10 FLEX-FUEL PILOT NOZZLE
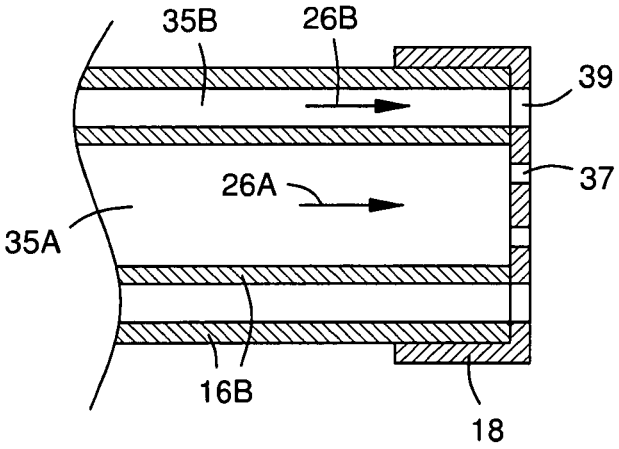

FIG 11 FLEX-FUEL INJECTOR
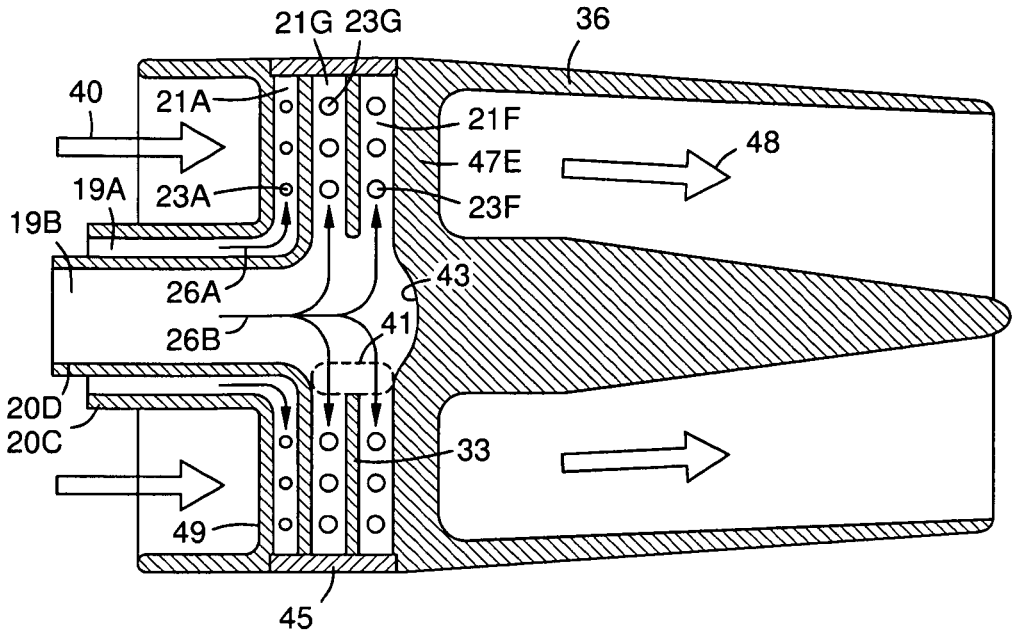

FLEX-FUEL INJECTOR FOR GAS TURBINES

This application claims benefit of the 26 Sep. 2008 filing date of U.S. provisional application No. 61/100,448.

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

This invention relates to a combustion engine, such as a gas turbine, and more particularly to a fuel injector that provides alternate pathways for gaseous fuels of widely different energy densities.

BACKGROUND OF THE INVENTION

In gas turbine engines, air from a compressor section and fuel from a fuel supply are mixed together and burned in a combustion section. The products of combustion flow through a turbine section, where they expand and turn a central shaft. In a can-annular combustor configuration, a circular array of combustors is mounted around the turbine shaft. Each combustor may have a central pilot burner surrounded by a number of main fuel injectors. A central pilot flame zone and a main fuel/air mixing region are formed. The pilot burner produces a stable flame, while the injectors deliver a stream of mixed fuel and air that flows past the pilot flame zone into a main combustion zone. Energy released during combustion is captured downstream by turbine blades, which turn the shaft.

In order to ensure optimum combustor performance, it is preferable that the respective fuel-and-air streams are well mixed to avoid localized, fuel-rich regions. As a result, efforts have been made to produce combustors with essentially uniform distributions of fuel and air. Swirler elements are used to produce a stream of fuel and air in which air and injected fuel are evenly mixed. Within such swirler elements are holes releasing fuel supplied from manifolds designed to provide a desired amount of a given fluid fuel, such as fuel oil or natural gas.

Fuel availability, relative price, or both may be factors for an operation of a gas turbine, so there is an interest not only in efficiency and clean operation but also in providing fuel options in a given turbine unit. Consequently, dual fuel devices are known in the art.

Synthetic gas, or syngas, is gas mixture that contains varying amounts of carbon monoxide and hydrogen generated by the gasification of a carbon-containing fuel such as coal to a gaseous product with a heating value. Modern turbine fuel system designs should be capable of operation not only on liquid fuels and natural gas but also on synthetic gas, which has a much lower BTU (British Thermal Unit) energy value per unit volume than natural gas. This criterion has not been adequately addressed. Thus, there is a need for a flex-fuel mixing device that provides efficient operation using fuels with low energy density, such as syngas, as well as higher energy fuels, such as natural gas.

BRIEF DESCRIPTION OF THE DRAWINGS

The invention is explained in the following description in view of the drawings that show:

FIG. 3 is a side sectional view of a prior art injector using injector swirler vanes.

FIG. 4 is a transverse sectional view of a prior art injector vane.

FIG. 5 is a side sectional view of a flex-fuel injector per aspects of the invention.

FIG. 6 is a transverse sectional view of a flex-fuel injector vane of FIG. 5.

FIG. 7 is a side sectional view of a flex-fuel injector second embodiment.

FIG. 8 is a transverse sectional view of a flex-fuel injector vane of FIG. 7.

FIG. 9 is a transverse sectional view of flex-fuel injector vanes in a third embodiment.

FIG. 10 is a conceptual side sectional view of a flex-fuel pilot nozzle per aspects of the invention.

FIG. 11 is a side sectional view of a flex-fuel injector fourth embodiment.

DETAILED DESCRIPTION OF THE INVENTION

Figure 1:
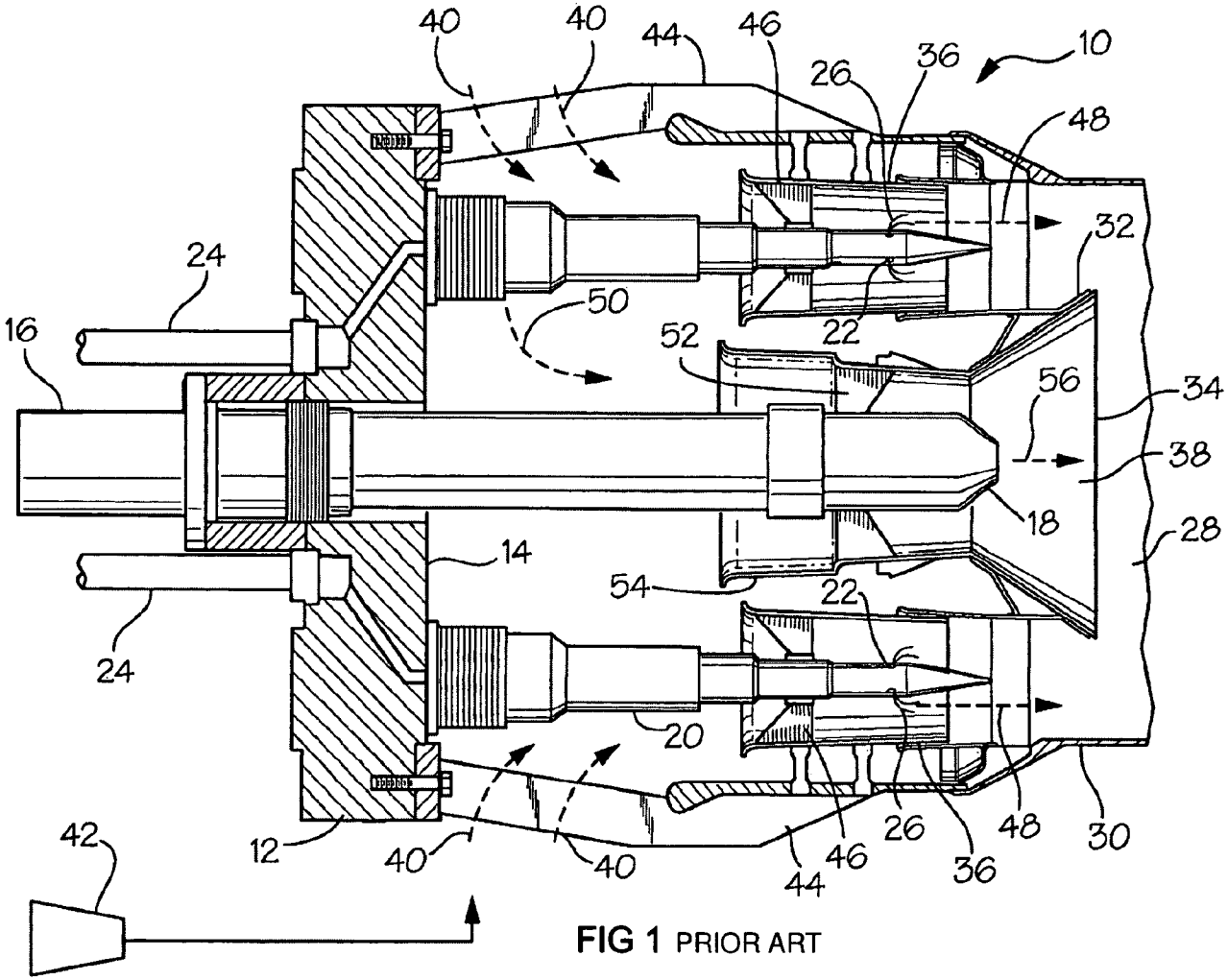
FIG 1 PRIOR ART
FIG. 1 is a side sectional view of a prior art gas turbine combustor.

FIG. 1 shows an example of a prior art gas turbine combustor 10, some aspects of which may be applied to the present invention. A housing base 12 has an attachment surface 14. A pilot fuel delivery tube 16 has a pilot fuel diffusion nozzle 18. Fuel inlets 24 provide a main fuel supply to main fuel delivery tube structures 20 with injection ports 22. A main combustion zone 28 is formed within a liner 30 downstream of a pilot flame zone 38. A pilot cone 32 has a divergent end 34 that projects from the vicinity of the pilot fuel diffusion nozzle 18 downstream of main swirler assemblies 36. The pilot flame zone 38 is formed within the pilot cone 32 adjacent to and upstream of the main combustion zone 28.

Compressed air 40 from a compressor 42 flows between support ribs 44 through the swirler assemblies 36. Within each main swirler assembly 36, a plurality of swirler vanes 46 generate air turbulence upstream of main fuel injection ports 22 to mix compressed air 40 with fuel 26 to form a fuel/air mixture 48. The fuel/air mixture 48 flows into the main combustion zone 28 where it combusts. A portion of the compressed air 50 enters the pilot flame zone 38 through a set of vanes 52 located inside a pilot swirler assembly 54. The compressed air 50 mixes with the pilot fuel 56 within pilot cone 32 and flows into pilot flame zone 38 where it combusts. The pilot fuel 56 may diffuse into the air supply 50 at a pilot flame front, thus providing a richer mixture at the pilot flame front than the main fuel/air mixture 48. This maintains a stable pilot flame under all operating conditions.

The main fuel 26 and the pilot fuel 56 may be the same type of fuel or different types, as disclosed in US Pre-Grant Pub No. 20070289311, of the present assignee, which is incorporated herein by reference. For example, natural gas may be used as a main fuel simultaneously with dimethyl ether ($CH_3OCH_3$) used as a pilot fuel.

Figure 2:
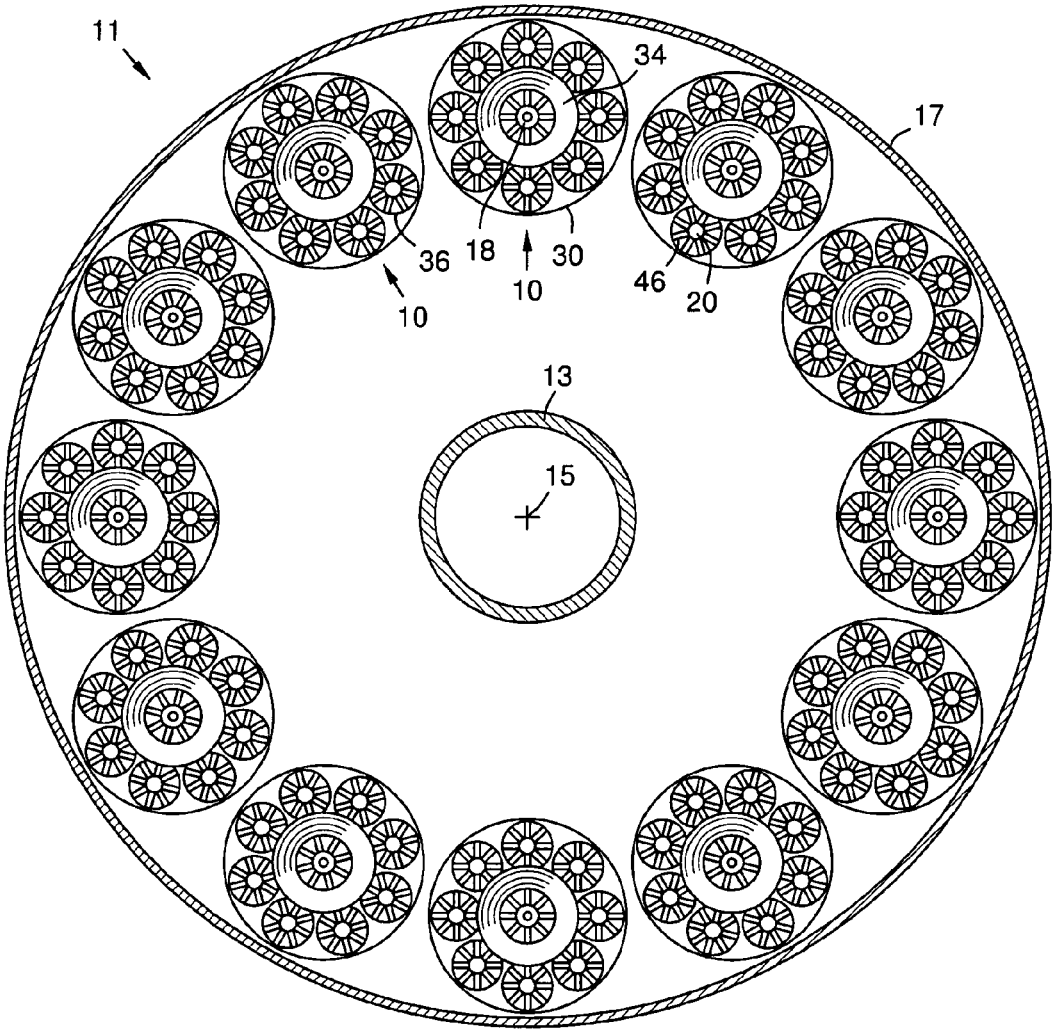
FIG 2 PRIOR ART
FIG. 2 is a conceptual sectional view of prior art can-annular combustors in a gas turbine, taken on a plane normal to the turbine axis.

FIG. 2 is a schematic sectional view of prior art combustors 10 installed in a can-annular configuration in a gas turbine 11 with a casing 17. This view is taken on a section plane normal to the turbine axis 15, and shows a circular array of combustors 10, disposed about a shaft 13, each having swirler assemblies 36 with swirler vanes 46 on main fuel delivery tubes 20. The present invention deals with a flex-fuel design for a swirler assembly 36 and to a pilot fuel nozzle 18. The invention may be applied to the configuration of FIG. 2, but is not limited to that configuration.

FIGS. 3 and 4 illustrate basic aspects of a prior art main fuel injector and swirler assembly 36 such as found in U.S. Pat. No. 6,832,481 of the present assignee. A fuel supply channel 19 supplies fuel 26 to radial passages 21 in vanes 47A that extend radially from a fuel delivery tube structure 20A. Combustion intake air 40 flows over the vanes 47A. The fuel 26 is injected into the air 40 from apertures 23 open between the radial passages 21 and an exterior surface 49 of the vane. The vanes 47A are shaped to produce turbulence or swirling in the fuel/air mixture 48.

The prior design of FIGS. 3 and 4 could use alternate fuels with similar viscosities and energy densities, but would not work as well for alternate fuels of highly dissimilar viscosities or energy densities. Syngas has less than half the energy density of natural gas, so the injector flow rate for syngas must be at least twice that of natural gas. This results in widely different injector design criteria for these two fuels.

Existing swirler assemblies 36 have been refined over the years to achieve ever-increasing standards of performance. Altering a proven swirler design could impair its performance. For example, increasing the thickness of the vanes 47A to accommodate a wider radial passage for a lower-energy-density fuel would increase pressure losses through the swirler assemblies, since there would be less open area through them. To overcome this problem, higher fuel pressure could be provided for the low-energy-density fuel instead of wider passages. However, this causes other complexities and expenses. Accordingly, it is desirable to maintain current design aspects of the swirler assembly with respect to a first fuel such as natural gas as much as possible, while adding a capability to alternately use a lower-energy-density fuel such as synthetic gas.

FIGS. 5 and 6 illustrate aspects of a fuel injector according to the invention. First and second fuel supply channels 19A and 19B alternately supply respective first and second fuels 26A, 26B to respective first and second radial passages 21A, 21B in vanes 47B that extend radially from a fuel delivery tube structure 20B. The fuel delivery tube structure 20B may be formed as concentric tubes as shown, or in another configuration of tubes. Combustion intake air 40 flows over the vanes 47B. The first fuel 26A is injected into the air 40 from first apertures 23A formed between the first radial passages 21A and an exterior surface 49 of the vane. Selectably, the second fuel 26B is injected into the air 40 from second apertures 23B formed between the second radial passages 21B and the exterior surface 49 of the vane. The vanes 47B may be shaped to produce turbulence in the fuel/air mixture 48, such as by swirling or other means, and may have a pressure side 49P and a suction side 49S as known in aerodynamics.

The first fuel delivery pathway 19A, 21A, 23A provides a first flow rate at a given backpressure. Herein "backpressure" means pressure exerted on a moving fluid at an exit of a fluid conduit. In order to accommodate fuels with dissimilar energy densities, the second fuel delivery pathway 19B, 21B, 23B provides a second flow rate at approximately the given backpressure. The first and second flow rates may differ from each other by at least a factor of two. This difference may be achieved by having a reduced pressure loss in the second fuel delivery pathway 19B, 21B, 23B when compared to a pressure loss in the first fuel delivery pathway 19A, 21A, 23A. This may be accomplished by having different cross-sectional areas in one or more respective portions of the two fuel delivery pathways, as known in fluid dynamics, and may be enhanced by differences in the shapes of the two pathways. For example, it was found that a rounded or gradual transition area 25 between the second fuel supply channel 19B and the second radial passages 21B substantially increases the second fuel flow rate at a given backpressure, due to reduction of turbulence in the radial passages 21B. Such transition area may take a curved form as shown, or may take a graduated form, such as a 45-degree transitional segment. Rounding or graduating of the transition 25 area may be done in an axial plane of the injector as shown and/or in a plane normal to the flow direction 40 (not shown).

FIG. 6 shows a sectional view of a fuel injector vane 47B as in FIG. 5, with a pressure side 49P, a suction side 49S, a front portion F and a back portion B. The front portion F may extend parallel to the flow direction of the intake air supply 40 to accommodate the second radial passage 21B and apertures 23B in the vane 47B. By extending the front portion F in-line with the airflow, differential pressures between the pressure and suction sides 49P, 49S occur downstream of the apertures 23A, 23B. This allows approximately equal fuel injection rates from the apertures of a given radial passage 21A, 21B on both sides 49P, 49S of the vane 47B. Extending the vane in this way can be done without increasing the vane width, thus maintaining known design aspects for the first fuel elements 21A, 23A and minimizing pressure loss on the fuel/air mixture 48 through the swirler assembly 36.

FIGS. 7 and 8 illustrate aspects of a second embodiment of the invention. A first fuel supply channel 19A provides a first fuel 26A to a first radial passage 21A in vanes 47C that extend radially from a fuel delivery tube structure 20B. Alternately, a second fuel supply channel 19B provides a second fuel 26B to second and third radial passages 21C, 21D in the vanes 47C. The fuel delivery tube structure 20B may be formed as concentric tubes as shown, or in another configuration of tubes. Combustion intake air 40 flows over the vanes 47C. The first fuel 26A is injected into the air 40 from first apertures 23A formed between the first radial passages 21A and an exterior surface 49 of the vane. Selectably, the second fuel 26B is injected into the air 40 from second and third sets of apertures 23C, 23D formed between the respective second and third radial passages 21C, 21D and the exterior surface 49 of the vane. The vanes 47C may be shaped to produce turbulence in the fuel/air mixture 48, such as by swirling or other means, and may have pressure and suction sides 49P, 49S.

The first fuel delivery pathway 19A, 21A, 23A provides a first flow rate at a given backpressure. In order to accommodate fuels with dissimilar energy densities, the second fuel delivery pathway 19B, 21C, 21D, 23C, 23D provides a second flow rate at the given backpressure. The first and second flow rates may differ by at least a factor of two. This difference may be achieved by providing different cross-sectional areas of one or more respective portions of the first and second fuel delivery pathways, and may be enhanced by differences in the shapes of the two pathways. It was found that contouring the transition area 31 between the fuel supply channel 19B and the second and third radial passages 21C, 21D increases the fuel flow rate at a given backpressure, due to reduction of fuel turbulence. A more equal fuel pressure between the radial passages 21C and 21D was achieved by providing an equalization area or plenum 31 in the transition area, as shown. This equalization area 31 is an enlarged and rounded or graduated common volume of the proximal ends of the radial passages 21C and 21D. A partition 33 between the radial passages 21C and 21D may start radially outwardly of the second fuel supply channel 19B. This creates a small plenum 31 that reduces or eliminates an upstream/downstream pressure differential at the proximal ends of the respective radial passages 21D, 21C. Rounding or graduating of the equalization area 31 may be done in an axial plane of the injector as shown and/or in a plane normal to the flow direction 40 (not shown).

FIG. 8 shows a sectional view of a fuel injector vane 47C as used in FIG. 7. It has a pressure side 49P, a suction side 49S, a front portion F and a back portion B. The front portion F extends parallel to the flow direction of the intake air supply 40 to accommodate the second and third radial passages 21C, 21D and apertures 23C, 23D. Since the front portion F is in-line with the airflow 40, differential pressures between the pressure and suction sides 49P, 49S occurs downstream of the apertures 23A, 23C, 23D. This allows approximately equal fuel flows to exit the apertures of a given radial passage 21A, 21C, 21D on both sides of the vane 47C. Extending the vane in this way can be done without increasing the vane width, thus maintaining known design aspects with respect to the first fuel elements 21A, 23A, and minimizing pressure loss on the fuel/air mixture 48 through the swirler assembly 36.

FIG. 9 shows a third embodiment of the invention. A first flex-fuel injector vane 47A has a first radial passage 21A and apertures 23A. The first radial passage 21A communicates with a first fuel supply channel as previously described. A second vane 47D has a second radial passage 21E and apertures 23E. The second radial passage 21E communicates with a second fuel supply channel as previously described. The first set of vanes may each comprise a trailing edge 41 that is angled relative to a flow direction 40 of an intake air supply. The second vane 47D may be positioned directly upstream of the first vane 47A. The first and second fuel delivery pathways may differ by at least a factor of two in fuel flow rate at a given backpressure as previously described, thus providing similar features and benefits to the previously described embodiments. Flex-fuel capability is provided for alternate fuels of highly different energy densities, without reducing the area of the intake air flow path between the vanes.

Main injector assemblies embodying the present invention may be used with diffusion or pre-mixed pilots. FIG. 10 shows a pilot fuel diffusion nozzle 18 that may be used in combination with the main flex-fuel injector assemblies 36 herein. A pilot fuel delivery tube structure 16B has first and second pilot fuel supply channels 35A, 35B for respective first and second alternate fuels 26A and 26B. Diffusion ports 37 for the first fuel have less area than diffusion ports 39 for the second fuel, thus providing benefits as discussed for the main flex-fuel injector assemblies 36 previously described. The first and second fuels 26A and 26B in the pilot supply channels may be the same fuels used for the main flex-fuel injector assemblies 36.

FIG. 11 illustrates aspects of a fourth embodiment of the invention, in which the arrangement of the fuel supply channels 19A, 19B and the relative positions of the respective radial passages is reversed from previous figures. A first fuel supply channel 19A provides a first fuel 26A to a first radial passage 21 A in vanes 47E that extend radially from a fuel delivery tube structure 20C, 20D. Alternately, a second fuel supply channel 19B provides a second fuel 26B to second and third radial passages 21F, 21G in the vanes 47E. The fuel delivery tube structure 20C, 20D may be formed as concentric cylindrical tubes, or in another configuration of tubes. Combustion intake air 40 flows over the vanes 47E. The first fuel 26A is injected into the air 40 from first apertures 23A formed between the first radial passage 21A and an exterior surface 49 of the vanes. Selectably, the second fuel 26B is injected into the air 40 from second and third sets of apertures 23F, 23G formed between the respective second and third radial passages 21F, 21G and the exterior surface 49 of the vanes. The vanes 47E may be shaped to produce turbulence in the fuel/air mixture 48, such as by swirling or other means.

The first fuel delivery pathway 19A, 21A, 23A provides a first flow rate at a given backpressure. In order to accommodate fuels with dissimilar energy densities, the second fuel delivery pathway 19B, 21F, 21G, 23F, 23G provides a second flow rate at the given backpressure. The first and second flow rates may differ by at least a factor of two. This difference may be achieved by providing different cross-sectional areas of one or more respective portions of the first and second fuel delivery pathways, and may be enhanced by differences in the shapes of the two pathways. It was found that contouring the transition area 41 between the second fuel supply channel 19B and the second and third radial passages 21F, 21G increases the fuel flow rate at a given backpressure, due to reduction of fuel turbulence. Fuel pressure differences between the radial passages 21F and 21G may be equalized by providing an equalization area or plenum 41 in the transition area, as shown. This equalization area 41 is an enlarged and rounded or graduated common volume of the proximal ends of the radial passages 21F and 21G. A partition 33 between the radial passages 21F and 21G may start radially outwardly of the second fuel supply channel 19B. For example, it may start radially flush with an inner diameter of the first fuel supply tube 20C. This creates a small plenum 41 that reduces or eliminates an upstream/downstream pressure differential at the proximal ends of the respective radial passages 21F, 21G. Rounding or graduating of the equalization area may be done in an axial plane of the injector as shown and/or in a plane normal to the flow direction 40 (not shown).

The vanes 47B, 47C, 47D, 47E of the present invention may be fabricated separately or integrally with the fuel delivery tube structure 20B, 20C, 20D or with a hub (not shown) to be attached to the fuel delivery structure 20B, 20C, 20D. If formed separately, the radial passages 21A, 21B, 21C and transition areas 25, 31, 41 may be formed by machining. Alternately, the vanes may be formed integrally with the fuel delivery tube structure 20B or a hub. For example, the fuel channels and/or radial passages may be formed of a high-nickel metal in a lost wax investment casting process with fugitive curved ceramic cores or by sintering a powdered metal or a ceramic/metal powder in a mold with a fugitive core such as a polymer that vaporizes at the sintering temperature to leave the desired internal void structure.

The embodiment of FIG. 11 may be alternately formed by casting and machining, as follows:

1) Cast the overall injector assembly 36 without forming the fuel channels 19A, 19B or radial passages 21A, 21F, 21G in the casting process;
2) Machine the radial passages 21A, 21F, 21G;
3) Machine the apertures 23A, 23F, 23G;
4) Machine the outer fuel channel 19A with an end mill up to a channel end 43;
5) Use a cutter or abrasive wheel to round the proximal ends of the radial passages 21A, 21F, 21G, at least in a plane normal to the flow direction 40;
6) Fabricate the inner fuel tube 20D separately, insert it into the outer fuel tube 20C, and braze the inner fuel tube in place;
7) Seal the distal ends of the radial channels with plugs 45.

In any of the embodiments herein, any of the injector "vanes" may be aerodynamic swirlers as shown, or they may have other shapes, such as the non-swirling vane 47D of FIG. 9, or twisted vanes. Non-swirler injection vanes may be used in combination with swirler airfoils upstream or downstream of the non-swirler injector vanes. The radial passages for the first and second fuels 26A, 26B may be in the same set of vanes, such that one or more radial passages for each fuel 26A, 26B are disposed in each vane, as in FIGS. 5, 7, and 11.

Alternately different radial passages for different fuels 26A, 26B may be in different injector vanes, as in FIG. 9.

In any of the embodiments of the invention herein, the first and second fuels 26A, 26B may be supplied from two or more independent supply facilities, such as storage tanks, supply lines, or an on-site integrated gasification facility. For example, the first fuel 26A may be natural gas supplied from a storage tank or supply line, while the second fuel 26B may be a synthetic gas supplied from on-site gasification of coal or other carbon-containing material. The first and second fuels 26A, 26B are selectively supplied alternately to the first main fuel supply channel 19A or to the second main fuel supply channel 19B respectively. The same first and second fuels 26A, 26B may also be selectively supplied alternately to the first pilot fuel supply channel 35A or to the second pilot fuel supply channel 35B respectively. The selection and switching between alternate fuels may be done by valves, including electronically controllable valves. Embodiments where more than two (such as three for example) radial passages may be fed by a central fuel supply channel may be envisioned.

The present invention provides alternate fuel capability in a fuel/air mixing apparatus, and allows the fuel/air mixing apparatus to maintain a predetermined and proven performance for a first fuel while adding an optimized alternate fuel capability for a second fuel having a widely different energy density from the first fuel.

While various embodiments of the present invention have been shown and described herein, it will be obvious that such embodiments are provided by way of example only. Numerous variations, changes and substitutions may be made without departing from the invention herein. For example, while exemplary embodiments having two radial passages for a lower BTU fuel are discussed, other embodiments may have more than two radial fuel passages fed by a single fuel supply, such as three radial passages in one embodiment. Accordingly, it is intended that the invention be limited only by the spirit and scope of the appended claims.

What is claimed is:

1. A gas turbine fuel injector for alternate fuels of different energy densities, comprising:

first and second main fuel delivery pathways through a main fuel delivery tube structure, through vanes extending radially therefrom, and exiting through respective first and second sets of apertures in exterior surfaces of the vanes, wherein each fuel delivery pathway is configured to independently supply a quantity of fuel sufficient to enable injector operation, and wherein only one fuel delivery pathway is necessary for injector operation;

wherein the first main fuel delivery pathway provides a first main fuel flow rate of a first fuel at a given fuel delivery pathway backpressure that is essentially common to both sets of fuel delivery pathway apertures, and the second main fuel delivery pathway provides a second main fuel flow rate of a second fuel that is at least about twice the first main fuel flow rate at the given fuel delivery pathway backpressure due to a lower pressure loss in the second main fuel delivery pathway from greater cross-sectional areas in respective portions of the second main fuel delivery pathway compared to the first main fuel delivery pathways, wherein the second fuel has a lower energy density than the first fuel and wherein within the vanes the second main fuel delivery pathway comprises a radially extending passage comprising a maximum width not greater than a maximum width of a radial extending passage of the first main fuel delivery pathway.

2. The gas turbine fuel injector of claim 1, comprising:

first and a second main fuel supply channels in the main fuel delivery tube structure that alternately supply a respective first main fuel and a second main fuel;

a first radial passage in each of a first grouping of the vanes, communicating with the first main fuel supply channel;

a second radial passage in each of a second grouping of the vanes, communicating with the second main fuel supply channel;

the first set of apertures open between the first radial passage and the exterior surface of said each vane of the first grouping of vanes;

the second set of apertures open between the second radial passage and the exterior surface of said each vane of the second grouping of vanes;

the first main fuel supply channel, the first radial passages, and the first set of apertures forming the first main fuel delivery pathway; and the second main fuel supply channel, the second radial passages, and the second set of apertures forming the second main fuel delivery pathway.

3. The fuel injector of claim 2, wherein a same set of vanes comprises the first and second groupings of vanes, wherein each vane of the same set includes at least one of the first radial passages and at least one of the second radial passages.

4. The fuel injector of claim 3, wherein each vane of the same set comprises a front portion and a back portion, the front portion is substantially aligned with a flow direction of a combustion intake air supply, the pack portion is angled relative to the flow direction of the combustion intake air supply, and the first and second radial passages are in the front portion of the vane.

5. The fuel injector of claim 4, wherein some apertures of the second set of apertures open on a pressure side of the vane, and some apertures of the second set of apertures open on a suction side of the vane.

6. The fuel injector of claim 3, further comprising a rounded or gradual transition area between the second main fuel supply channel and each of the second radial passages, wherein the rounded or gradual transition area reduces turbulence in a second main fuel flow in the second radial passages at the given backpressure relative to turbulence in a first main fuel flow in the first radial passages at the given backpressure.

7. The fuel injector of claim 6, wherein the second main fuel delivery pathway further comprises:

a third radial passage in each vane of the same set, the second and third radial passages both communicating with the second main fuel supply channel;

wherein the rounded or gradual transition area comprises an enlarged and rounded common volume of proximal ends of the second and third radial passages; and wherein a partition between the second and third radial passages has a proximal end that starts radially outwardly from the second main fuel supply channel, thus forming an equalization plenum that reduces an upstream/downstream main fuel pressure differential at the proximal ends of the second and third radial passages.

8. The fuel injector of claim 2, wherein each vane of the first grouping of vanes comprises a trailing edge that is angled relative to a flow direction of an intake air supply, and each vane of the second grouping of vanes is positioned directly upstream of a respective vane of the first grouping of vanes.

9. The fuel injector of claim 1 installed in a gas turbine combustor, wherein the combustor further comprises:

a pilot fuel delivery tube structure;

first and second pilot fuel supply channels in the pilot fuel delivery tube structure that alternately supply respective first and second pilot fuels;

a pilot fuel diffusion nozzle on an end of the pilot fuel delivery tube structure;

a first set of pilot fuel diffusion ports in the pilot fuel diffusion nozzle communicating with the first pilot fuel supply channel;

a second set of pilot fuel diffusion ports in the pilot fuel diffusion nozzle communicating with the second pilot fuel supply channel;

wherein the first pilot fuel supply channel and the first set of pilot fuel diffusion ports provide a first pilot fuel flow rate at a given pilot fuel supply channel backpressure that is essentially common to both sets of diffusion ports; and wherein the second pilot fuel supply channel and the second set of pilot fuel diffusion ports provide a second pilot fuel flow rate that is at least about twice the first pilot fuel flow rate at the given pilot fuel supply channel backpressure.

10. The fuel injector of claim 1, wherein:

the delivery tube structure comprises coaxial cylindrical inner and outer tubes, forming an annular first main fuel supply channel between the inner and outer tubes, and providing a second main fuel supply channel in the inner tube;

the first main fuel delivery pathway comprises a first radial passage in the vanes communicating with the first main fuel supply channel;

the second main fuel delivery pathway comprises second and third radial passages in the vanes communicating with the second main fuel supply channel:

the first radial passage is upstream of the second and third radial passages; and a partition between the second and third radial passages has a proximal end that starts radially outwardly from the second main fuel supply channel, thus forming an equalization plenum that reduces an upstream/downstream main fuel pressure differential at proximal ends of the second and third radial passages.

11. A gas turbine fuel injector for alternate fuels of different energy densities, comprising:

a plurality of vanes extending radially from a main fuel delivery tube structure;

first and second main fuel supply channels in the main fuel delivery tube structure that alternately supply a respective first main fuel and a second main fuel, wherein the second main fuel has a lower energy density than the first main fuel;

a first radial passage in each of a first grouping of the vanes, communicating with the first main fuel supply channel;

a second radial passage in each of a second grouping of the vanes, communicating with the second main fuel supply channel;

a first set of apertures open between the first radial passage and an exterior surface of said each vane of the first grouping of vanes;

a second set of apertures open between the second radial passage and an exterior surface of said each vane of the second grouping of vanes;

the first main fuel supply channel, the first radial passages, and the first sets of apertures forming a first main fuel delivery pathway having a first main fuel flow rate at a given fuel supply channel backpressure that is essentially common to both sets of apertures;

the second main fuel supply channel, the second radial passages, and the second sets of apertures forming a second main fuel delivery pathway having a second main fuel flow rate that differs from the first main fuel flow rate by at least about a factor of two at the given fuel supply channel backpressure, wherein the injector is operable on either fuel delivery pathway; and wherein within the second grouping of the vanes the second radial passage comprising a maximum width not greater than a maximum width of the first radial passage.

12. The fuel injector of claim 11, wherein a same set of vanes comprises the first and second grouping of vanes, wherein each vane of the same set includes at least one of the first radial passages and at least one of the second radial passages.

13. The fuel injector of claim 12, wherein each vane of the same set comprises a front portion and a back portion, the front portion is substantially aligned with a flow direction of an intake air supply, the back portion is angled relative to me flow direction of the intake air supply, and the first and second radial passages are in the front portion of the vane.

14. The fuel injector of claim 13, wherein some apertures of the second set of apertures open on a pressure side of the vane, and some apertures of the second set of apertures open on a suction side of the vane.

15. The fuel injector of claim 12, wherein the second flow rate is at least twice the first flow rate at the given fuel supply channel backpressure due to greater cross-sectional areas in respective portions of the second main fuel delivery pathway compared to the first main fuel delivery pathway.

16. The fuel injector of claim 15, further comprising a rounded or gradual transition area between the second main fuel supply channel and each of the second radial passages, wherein the rounded or gradual transition area reduces turbulence in a second main fuel flow in the second radial passages at th6 given fuel supply channel backpressure relative to turbulence in a first main fuel flow in the first radial passages at the given fuel supply channel backpressure.

17. The fuel injector of claim 16, wherein the second main fuel delivery pathway further comprises:

a third radial passage in each vane of the same set, the second and third radial passages both communicating with me second main fuel supply channel;

wherein the rounded or gradual transition area comprises an enlarged and rounded common volume of proximal ends of the second and third radial passages; and wherein a partition between the second and third radial passages has a proximal end that starts radially outwardly from the second main fuel supply channel, thus forming an equalization plenum that reduces an upstream/downstream main fuel pressure differential at me proximal ends of the second and third radial passages.

18. The fuel injector of claim 11, wherein the first grouping of vanes each comprise a trailing edge that is angled relative to a flow direction of a combustion intake air supply, and each vane of the second grouping is positioned directly upstream of a respective vane of the first set of vanes.

19. The fuel injector of claim 11 installed in a gas turbine combustor, wherein the combustor further comprises:

a pilot fuel delivery tube structure;

first and second pilot fuel supply channels in the pilot fuel delivery tube structure that alternately supply the respective first main fuel and the second main fuel as respective first and second pilot fuels;

a pilot fuel diffusion nozzle on an end of the pilot fuel delivery tube structure;

a first set of pilot fuel diffusion ports in the pilot fuel diffusion nozzle communicating with the first pilot fuel supply channel;

a second set of pilot fuel diffusion ports in the pilot fuel diffusion nozzle communicating with the second pilot fuel supply channel;

wherein the first pilot fuel supply channel and the first set of pilot fuel diffusion ports provides a first pilot fuel flow rate at a given pilot fuel supply channel backpressure that is essentially common to both sets of diffusion ports;

wherein the second pilot fuel supply channel and the second set of pilot fuel diffusion ports provides a second pilot fuel flow rate that differs from the first pilot fuel flow rate by at least about a factor of two at the given pilot fuel supply channel backpressure.

20. A gas turbine fuel injector for alternate fuels, comprising a plurality of vanes extending radially from a fuel delivery tube structure;

a first and a second fuel supply channel in the fuel delivery tube structure;

a first and a second radial passage in each vane, the first and second radial passage communicating with the respective fuel supply channel;

first and second sets of apertures between the respective radial passage and an exterior surface of the vane;

the first fuel supply channel, the first radial passage, and the first set of apertures forming a first fuel delivery pathway that provides a first fuel flow rate at a given difference between a first fuel supply channel inlet pressure and a backpressure proximate the first set of apertures;

the second fuel supply channel, the second radial passage, and the second set of apertures forming a second fuel delivery pathway that provides a second fuel flow rate of at least twice the first fuel flow rate at the given pressure difference;

wherein the difference between the first and second fuel flow rates is achieved by different cross-sectional areas in respective portions of the first and second fuel delivery pathways and by a rounded transition area between the second fuel supply channel and each of the second radial passages; and wherein a first fuel is supplied to the first fuel supply channel and alternately, a second fuel having about half or less energy density of the first fuel is supplied to the second fuel supply channel, and wherein each fuel delivery pathway is configured to independently supply a quantity of fuel sufficient to enable injector operation, and wherein only one fuel delivery pathway is necessary for injector operation; and wherein a perimeter of a largest cross section of the second radial passage is substantially aligned with a perimeter of the first radial passage with respect to a flow direction of compressed air flowing thereby.

* * * * *